United States Patent [19]

Plymale

[11] 4,351,169

[45] Sep. 28, 1982

[54] RESTRAINING DEVICE

[76] Inventor: Jay F. Plymale, 7437 Birkner Dr., Kent, Ohio 44240

[21] Appl. No.: 190,229

[22] Filed: Sep. 24, 1980

[51] Int. Cl.[3] ..... E05B 75/00
[52] U.S. Cl. ..... 70/16
[58] Field of Search ..... 70/16, 14, 15, 17, 18; 24/255 BS; 119/126, 128, 151, 152, 153, 154

[56] References Cited

U.S. PATENT DOCUMENTS

| | | | |
|---|---|---|---|
| 1,171,440 | 2/1916 | Immell | 119/154 |
| 3,545,237 | 12/1970 | Thompson | 70/16 |
| 3,815,853 | 6/1974 | Bahner | 24/255 BS |
| 4,147,423 | 7/1979 | Murphy | 70/17 |

FOREIGN PATENT DOCUMENTS

| | | | |
|---|---|---|---|
| 247666 | 6/1912 | Fed. Rep. of Germany | 70/16 |

OTHER PUBLICATIONS

Funk & Wagnalls Dictionary—Thief Catcher—Pub. 1895, p. 1874.

*Primary Examiner*—Robert L. Wolfe
*Attorney, Agent, or Firm*—James A. Hudak

[57] ABSTRACT

A device (10) is disclosed for restraining a criminal suspect during a search by law enforcement officers. The device (10) includes a base member (12), which is attachable to the surface of a police vehicle or any other stationary surface, and a plurality of arm members (14) flexibly attached to the base member (12) and lockingly engageable therewith. Complementary openings (16, 18) are provided in the arm members (14) and the base member (12), respectively, to receive the wrists of the suspect being restrained. The surface forming each of the complementary openings (16, 18) is provided with a plurality of tangs (20) which engage and apply a force to the suspect's wrists if he attempts to free himself from the device (10) prior to the device (10) being opened by a law enforcement officer.

5 Claims, 4 Drawing Figures

RESTRAINING DEVICE

TECHNICAL FIELD

The present invention relates to restraining devices in general, and more particularly to restraining devices used by law enforcement officers when searching a criminal suspect.

BACKGROUND ART

There are numerous prior art patents which disclose handcuffs, shackles, nippers, etc., all of which are used in law enforcement work. These devices typically are used to retain a grip on the suspect or to restrain the movement of the suspect's hands relative to each other. For example, U.S. Pat. No. 375,945 discloses a device which is similar to handcuffs and which is used for simultaneously shackling two parts of the suspect's body, such as his wrists. Thus, this device restricts movement of the suspect's wrists relative to one another but does not prevent the suspect from simultaneously using both of his arms and harming or injuring the law enforcement officer involved. Similarly, the other devices disclosed in the prior art do not prevent the suspect from simultaneously using both of his arms in an attempt to harm the officer when performing his duties. One of the duties wherein this sometimes occurs is searching a suspect. During such a search, the suspect is generally requested to assume a position wherein the suspect's legs are spread apart and his hands are placed against a police vehicle or other stationary surface. Since the suspect is not restrained in any way when in this position, the officer conducting the search is very vulnerable to attack. Even if the suspect is handcuffed or shackled during this search, the officer is still vulnerable to attack since the suspect's arms are not restrained. Many incidents have occurred because of the suspect's ability to move his arms, either individually or jointly, during such a search.

Because of the foregoing, it has become desirable to develop a device that restrains both of the suspect's arms during a search and prevents the removal of his arms from same until after the search has been completed.

SUMMARY OF THE INVENTION

The present invention solves the aforementioned problems associated with the prior art as well as other problems by providing a device which mounts on the body of a police vehicle or any stationary surface and which is comprised of a frame having complementary openings in the base and arm portions thereof for eachd of the wrists of the suspect to be searched. A separate arm member is provided for each of the wrists, and is flexibly connected to the base of the frame, thus permitting the individual insertion and removal of each of the suspect's wrists from the device. The surface forming each of the complementary openings in the base and arm portions is provided with a plurality of tangs which are oriented so as to engage and apply pressure to the suspect's hands if he attempts to free himself from the device prior to the device being opened by the law enforcement officer. A locking mechanism is provided on each end of the device allowing each arm member to be released separately after the search procedure has been completed.

In view of the foregoing, it will be seen that one aspect of the present invention is to provide a device for restraining a suspect to be searched, and which includes a plurality of tangs on the surfaces defining the openings provided therein to engage and apply a force to the suspect's wrists if he attempts to free himself from the device.

Another aspect of the present invention is to provide a restraining device which prevents the simultaneous movement of the suspect's arms when his wrists are engaged thereby thus insuring the safety of the law enforcement officer conducting the search.

A further aspect of the present invention is to provide a restraining device which is permanently mounted on a police vehicle or any stationary surface so as to be readily available to the law enforcement officers for the search of a suspect.

These and other aspects of the present invention will be more clearly understood after a review of the following description of the preferred embodiment when considered with the drawings.

DESCRIPTION OF THE PREFERRED EMBODIMENT

Figure 1:
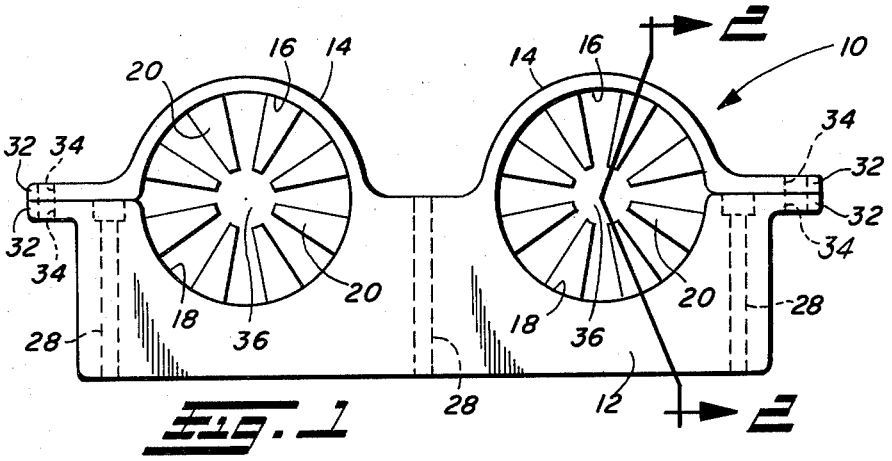
FIG. 1 is a front elevation view of the restraining device constructed in accordance with the present invention.

Referring now to the drawings wherein the illustrations are for the purpose of describing the preferred embodiment of the invention and are not intended to limit the invention hereto, FIG. 1 is a front elevation view of the restraining device 10. Device 10 is comprised of a base member 12 having a plurality of arm members 14 flexibly attached thereto. Each of the arm members 14 has a generally semi-circular opening 16 formed therein which coincides with a complementary semi-circular opening 18 provided in the base member 12. Inwardly directed tangs 20 are provided on the surfaces defining the semi-circular openings 16 and 18 provided in the arm member 14 and the base memberd 12, respectively, to grip the wrists of the person being restrained, as will be hereinafter described.

Figure 2:
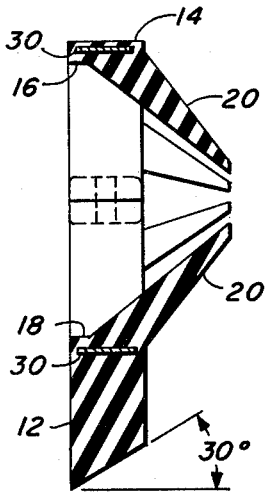
FIG. 2 is a cross-sectional view of the device taken along section-indicating lines 2—2 of FIG. 1.
Figure 3:
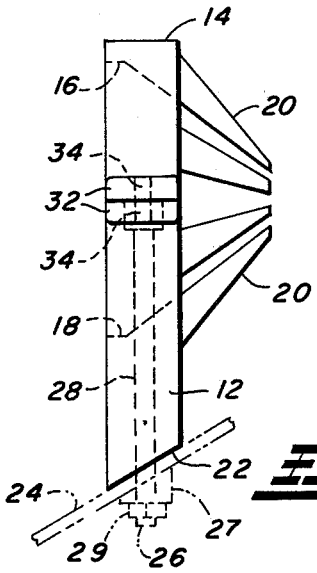
FIG. 3 is an end elevation view of the device illustrated in FIG. 1.
Figure 4:
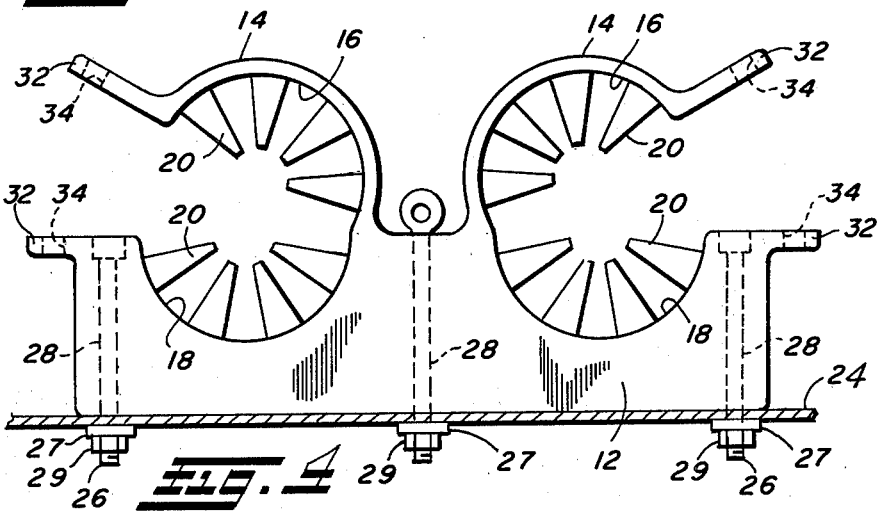
FIG. 4 is a front elevation view of the device as mounted on the surface of a police vehicle or any other stationary surface and illustrating the arm members thereof in an open position.

The base member 12 and the arm member 14 are generally of an integrally molded construction and are formed from an easily molded material, such as rubber or plastic. The semi-circular openings 16 and 18 and the tangs 20 are formed during the molding process and typically no further finishing operations are required. The bottom surface 22 of the base member 12 is formed at an angle of approximately 30° with respect to the horizontal, as illustrated in FIG. 2, so that the device 10 will be in the correct orientation, when mounted on a police vehicle or any other stationary surface, to receive the wrists of the suspect being restrained. Because the base member 12 is formed from a resilient material, such as rubber or plastic, the device can be mounted on the hood, front fender, or trunk deck of the police vehicle or any other surface 24 without scratching and/or marring same, as shown in FIG. 4. Generally, the base member 12 is mounted by means of a plurality of fasteners 26 received through apertures 28 provided therethrough. A bevel washer 27 is utilized on the opposite side of the mounting surface 24 to provide a seating surface substantially perpendicular to the longitudinal axis of the fastener for a nut 31 or similar device which is utilized to retain the fastener 26. The fastener 26 positioned between the openings 18 provided in the base member 12 can be an eye bolt to receive a handcuff if it is decided to further restrain the suspect by means of handcuffs during the search procedure.

A spring metal ring 30 is integrally molded into the resilient material adjacent the surfaces defining the semi-circular openings 16 and 18 provided in the arm member 14 and the base member 12, respectively. This spring metal ring 30 greatly increases the strength of the arm members 14, particularly at their point of connection to the base member 12 and causes the arm members 14 to assume a normally closed position with respect to the base member 12. Each of the outer ends of the metal ring 30 is formed with complementary tab-like projections 32 each having an aperture 34 formed therein and positioned so as to be aligned with each other to receive a locking mechanism, such as a padlock (not shown). In this manner each of the arm members 14 can be individually locked to the base member 12.

Typically, the device 10 is in the locked condition, i.e., the arm members 14 are locked to the base member 12 by means of some locking device received through the apertures 34 provided in the tab-like projections 32 on the metal ring 30 or attached to these projections 32. Each of the hands of the suspect being restrained is received through an opening 36 formed by the semi-circular opening 16 provided in an arm member 14 and its complementary semi-circular opening 18 provided in the base member 12. After the suspect's hands have been received through the openings 36, the tangs 20 completely surround and engage the suspect's wrists applying a force thereto. Because of the inwardly directed orientation of the tangs 20, the suspect is prevented from withdrawing his wrists from the device. Any effort by the restrained person to withdraw his wrists from the device 10 results in an increased force being applied to his wrists by the tangs 20. To further insure that the suspect cannot escape from the device 10 during the search, handcuffs can be used to cuff the hands jointly together or individually to the eye bolt fastener 24. Thus, the device 10 is virtually escape-proof and extremely beneficial during the search of suspects.

After the searchd has been completed, each of the arm members 14 can be individually unlocked by removing the locking mechanism received through the apertures 34 or attached to the tab-like projections 32 on the ends of the metal ring 30 associated with the arm member 14. After removal of the locking mechanism, the arm member 14 can be moved outwardly away from the base member 12 permitting the removal of the suspect's wrist from the device. This ability to individually unlock each arm member 14 and separately free each wrist of the suspect further insures the safety of the law enforcement officer completing the search.

Certain modifications and improvements will occur to those skilled in the art upon reading the foregoing description. It will be understood that all such improvements and modifications have been deleted herein for the sake of conciseness and readability but are properly within the scope of the following claims.

I claim:

1. A device for restraining a person comprising a base member having a plurality of openings adjacent the top surface thereof, one or more arm members flexibly attached to said base member and having one or more openings adjacent the bottom surface thereof, said one or more openings in said one or more arm members being so positioned therein so as to be complementary to said plurality of openings in said base member to receive the wrists of the person being restrained, and tang members attached to and angularly directed away from the surfaces defining said plurality of openings in said base member and attached to and angularly directed away from the surfaces defining said one or more openings in said one or more arm members, said tang members being engageable with the surface of the wrists of the person being restrained and applying a force thereto.

2. The restraining device as defined in claim 1 wherein the outer ends of said tang members attached to the surfaces defining said plurality of openings in said base member are directed towards the outer ends of said tang members attached to the surfaces defining said one or more openings in said one or more arm members so as to apply an increasing force on the surface of the wrists of the person being restrained as said person attempts to withdraw his wrists from said device when said device is in the closed position.

3. The restraining device as defined in claim 1 wherein said tang members are resiliently flexible so as to be engageable with the surface of the wrists of said person being restrained.

4. The restraining device as defined in claim 1 further including means for locking said one or more arm members in an engaged relationship with said base member.

5. A device for restraining a person comprising a base member having a plurality of openings adjacent the top surface thereof, one or more arm members flexibly attached to said base member and having one or more openings adjacent the bottom surface thereof, said one or more openings in said one or more arm members being so positioned therein so as to be complementary to said plurality of openings in said base member to receive the wrists of the person being restrained, tang members attached to the surfaces defining said plurality of openings in said base member and to the surfaces defining said one or more openings in said one or more arm members, said tang members being engageable with the surface of the wrists of the person being restrained and applying a force thereto, and reinforcing means molded into said device to provide support to said surfaces defining said plurality of openings in said base member and to said surfaces defining said one or more openings in said one or more arm members.

* * * * *